US009849709B2

(12) United States Patent
Muraoka

(10) Patent No.: US 9,849,709 B2
(45) Date of Patent: Dec. 26, 2017

(54) PRINTING BLANKET, PRINTING DEVICE, AND METHOD OF MANUFACTURING PRINTING BLANKET

(75) Inventor: Kouji Muraoka, Fukui (JP)

(73) Assignee: SHUHOU CO., LTD., Fukui (JP)

( * ) Notice: Subject to any disclaimer, the term of this patent is extended or adjusted under 35 U.S.C. 154(b) by 1081 days.

(21) Appl. No.: 13/581,751

(22) PCT Filed: May 13, 2010

(86) PCT No.: PCT/JP2010/003236
§ 371 (c)(1),
(2), (4) Date: Aug. 29, 2012

(87) PCT Pub. No.: WO2011/108034
PCT Pub. Date: Sep. 9, 2011

(65) Prior Publication Data

US 2012/0318154 A1 Dec. 20, 2012

(30) Foreign Application Priority Data

Mar. 5, 2010 (JP) ..... 2010-049269
Apr. 21, 2010 (JP) ..... 2010-097747

(51) Int. Cl.
*B41N 10/04* (2006.01)
*B41F 17/00* (2006.01)
(Continued)

(52) U.S. Cl.
CPC ..... *B41N 10/02* (2013.01); *B41F 13/193* (2013.01); *B41F 17/001* (2013.01);
(Continued)

(58) Field of Classification Search
CPC .. B41N 10/02; B41K 3/18; B41K 3/12; F41F 17/001; B41P 2200/31
(Continued)

(56) References Cited

U.S. PATENT DOCUMENTS 4,181,765 A * 1/1980 Harmony ..... 428/157
5,452,658 A * 9/1995 Shell ..... 101/401.1
(Continued)

FOREIGN PATENT DOCUMENTS

CN 201268140 Y 9/2009
EP 0 179 359 A2 4/1986
(Continued)

OTHER PUBLICATIONS

Machine translation of French Patent Publication No. FR-2686547A3, originally published Jul. 1993, 7 pages.*
(Continued)

*Primary Examiner* — William P Bell
(74) *Attorney, Agent, or Firm* — Ladas & Parry LLP

(57) ABSTRACT

A printing pad (2) having a double structure comprising a roughly quadrangular pyramid-shaped elastic body (2*a*) and a coating layer (2*d*) which covers a definite range of a side face (2*b*) including an apex (2*c*) of the elastic body (2*a*), wherein said elastic body (2*a*) and the coating layer (2*d*) contain a silicone oil to ensure ink transfer (receiving and delivering) and impart elasticity (flexibility), and the coating layer (2*d*) is made harder (i.e., containing the silicone oil in a smaller amount) than the elastic body (2*a*).

3 Claims, 6 Drawing Sheets

(51) Int. Cl.
*B41N 10/02* (2006.01)
*B41F 13/193* (2006.01)

(52) U.S. Cl.
CPC ..... *B41N 2210/02* (2013.01); *B41N 2210/04* (2013.01); *B41N 2210/14* (2013.01)

(58) Field of Classification Search
USPC ..... 101/41, 379, 333; 428/909
See application file for complete search history.

(56) References Cited

U.S. PATENT DOCUMENTS

| | | | |
|---|---|---|---|
| 2006/0185541 A1 | 8/2006 | Czeranka et al. | |
| 2008/0105145 A1 * | 5/2008 | Schaafsma et al. | 101/41 |

FOREIGN PATENT DOCUMENTS

| | | | |
|---|---|---|---|
| EP | 0 718 098 | A2 | 6/1996 |
| EP | 718098 | A2 * | 6/1996 |
| EP | 1 795 363 | A1 | 6/2007 |
| EP | 1 808 303 | A1 | 7/2007 |
| FR | 2686547 | A3 * | 7/1993 |
| JP | 47367/1982 | | 3/1982 |
| JP | 62-132691 | A | 6/1987 |
| JP | 2005-111665 | A | 4/2005 |
| JP | 2008-114496 | A | 5/2008 |
| WO | 02/45961 | A1 | 6/2002 |
| WO | WO 0245961 | A1 * | 6/2002 |
| WO | WO 2010034218 | A1 * | 4/2010 |

OTHER PUBLICATIONS

Non-English Action dated Apr. 1, 2014 for Application No. CN 201080065203.9 with English translation.
Non-English Action dated Jun. 1, 2014 for Korean Application No. 10-2012-7023005 with English translation.
Non-English Action dated Oct. 1, 2013 for Application No. JP2010-049269A and an English-language translation.
Non-English Action Dec. 3, 2013 for Application No. JP2010-049269A and an English-language translation.
English Patent Abstracts of Japan 2005-111665 A Published Apr. 28, 2005 and Machine English Translation.
English Patent Abstracts of Japan 62-132691 A Published Jun. 15, 1987.
English Patent Abstracts of Japan 2008-114496 A Published May 22, 2008 and Machine English Translation.
Microfilm of the specification and drawings annexed to the request of Japanese Utility Model Application No. 124309/1980 (Laid-open No. 47367/1982) (Nippon Kyokumen Insatsuki Kabushiki Kaisha), Mar. 16, 1982 (Mar. 16, 1982), claims; fig. 1.
Non-English Action dated Nov. 20, 2014 for Korean Application No. 10-2012-7023005 with English translation.
Non-English Action dated Nov. 15, 2014 for Chinese Application No. 201080065203.9 with English translation.
Supplementary European Search Report dated Oct. 2, 2015 for Application No. EP 10846942.0.
Espacenet English abstract of CN 201268140 Y.

* cited by examiner (a)

(b)

PRINTING BLANKET, PRINTING DEVICE, AND METHOD OF MANUFACTURING PRINTING BLANKET

RELATED APPLICATION INFORMATION

This application is a 371 of International Application PCT/JP2010/003236 filed 13 May 2010 entitled "Printing Blanket, Printer And Method For Producing Printing Blanket", which was published on 9 Sep. 2011, with International Publication Number WO 2011/108034 A1, and which claims priority from Japanese Patent Applications No. 2010-49269 filed on 5 Mar. 2010 and 2010-97747 filed on 21 Apr. 2010, the content of which is incorporated herein by reference.

TECHNICAL FIELD

The present invention generally relates to printing blankets, printing devices, and methods of manufacturing printing blankets, and particularly relates to a printing blanket suitable for pad printing that involves picking up ink and transferring the picked-up ink to a to-be-printed surface, a printing device having the printing blanket, and a method of manufacturing the printing blanket.

BACKGROUND ART

Pad printing is a conventional process in which a printing blanket (i.e., a printing pad) is pressed against a printing original plate (i.e., an image plate), on which ink is disposed in accordance with a printing pattern, so as to transfer (pick up) the ink from the printing original plate, and then the printing blanket is pressed against a to-be-printed surface so as to transfer (deliver) the ink to a to-be-printed surface, whereby the printing pattern is printed onto the to-be-printed surface. There is disclosed an invention in which, in order to prevent reduction in the printing quality, a printing original plate is reciprocally moved so as to shake and stir ink in an ink box that is in contact with the printing original plate and thereby make the ink less likely to be cured (see Patent Literature 1, for example).

CITATION LIST

Patent Literature

Patent Literature 1: Japanese Unexamined Patent Application Publication No. 2008-114496 (Pages 9-10, FIG. 1)

SUMMARY OF INVENTION

Technical Problem

According to the invention disclosed in Patent Literature 1, a printing blanket is an elastic body made of silicone rubber or the like containing silicone oil so as to impart elasticity (flexibility), and is formed in a substantially hemispherical shape (bullet shape) or a substantially semi-cylindrical shape (bullet-shaped cross section). Further, in order to make the printing blanket fit to the to-be-printed surface, the printing blanket needs to be soft (i.e., have a low elastic modulus and be easily elastically deformed).

However, when the printing blanket is pressed onto the printing original plate and is deformed, silicone oil in the printing blanket may come out to the surface thereof, or the printing blanket may become locally worn or damaged, which results in the following problems.

(a) It becomes difficult to transfer (deliver) the ink from the printing original plate to the printing blanket, which results in a blurred or unclear printing pattern being printed on the to-be-printed surface.

(b) Further, ink and silicone oil accumulate on the printing original plate, and the resulting excessive amount of ink and oil contaminate the printing original plate. The contaminants are transferred to the printing blanket, which results in a smeared printing pattern being printed on the to-be-printed surface.

(c) Furthermore, in the case of removing ink not having been picked up and remaining on the printing original plate, frequent cleaning may cause damage to the printing original plate and roughen the surface thereof, which may reduce the service life of the printing original plate. This leads to frequent replacement with a new printing original plate, resulting in increased printing costs (equipment costs).

(d) In the case of applying a coating to the to-be-printed surface with the printing pattern printed thereon, the coating is repelled by the silicone oil component, and therefore a desired coating cannot be formed.

(e) On the other hand, in the case where the hardness of the printing blanket is increased, it becomes difficult to print the printing pattern across a wide area on a curved surface. Then, the printable area is reduced, which may result in reduced design properties of the printing pattern. In the case of printing the printing pattern across a wide area, it is necessary to perform small area printing a plurality of times, which increases the print costs.

(f) Further, since the ink is transferred to the to-be-printed surface by pressing the printing blanket against the flat printing original plate and the curved to-be-printed surface, the distal end (the lowermost point or the lowermost line) of the printing blanket and the portion in the vicinity thereof become particularly degraded or damaged, or the printing blanket may become damaged by a protruding portion of the to-be-printed surface. Such local degradation or damage makes the printing blanket unusable, and thus the entire printing blanket is discarded.

The present invention has been made to overcome the above problems. A first object of the present invention is to provide a printing blanket that excellently fits to a curved to-be-printed surface while preventing silicone oil contained in the printing blanket from coming out to the surface of the printing blanket when the printing blanket is deformed. A second object of the present invention is to provide a printing device having the printing blanket. A third object of the present invention is to provide a method of manufacturing a printing blanket that, even if the printing blanket is locally degraded or damaged, does not need to be discarded entirely and can perform high-quality printing.

Solution to Problem (1) According to the present invention, there is provided:

a printing blanket that is configured to pick up ink, which has been applied to a printing original plate in accordance with a printing pattern, from the printing original plate by being pressed against the printing original plate and then deliver the picked-up ink to a to-be-printed surface by being pressed against the to-be-printed surface, and thereby print the printing pattern on the to-be-printed surface, the printing blanket including a double-layer structure having:

a flexible elastic body containing silicone oil; and a lesser-flexible coating layer containing silicone oil and covering a part of a surface of the elastic body.

(2) With regard to (1) described above, the elastic body has a cylindrical shape, and the coating layer covers an outer circumferential surface of the main body.

(3) With regard to (1) described above, the elastic body has a substantially semi-cylindrical shape, a substantially conical shape, or a substantially pyramidal shape, and the coating layer covers a predetermined area of the elastic body containing an apex thereof.

(4) With regard to (3) described above, the thickness of the coating layer is greater at the apex of the elastic body and in the vicinity of the apex than at a position away from the apex.

(5) Further, according to the present invention, there is provided:

a printing device including:

the printing blanket of any one of (1) through (4);

a pad mounting unit on which the printing blanket is disposed;

a moving unit configured to movably support the pad mounting unit;

a controller configured to control movement of the moving unit; and a main body in which the moving unit and the controller are disposed.

(6) Further, according to the present invention, there is provided:

a method of manufacturing a printing blanket including an elastic body having a substantially semi-cylindrical shape and a sheet bonded to a side surface of the elastic body having a substantially arcuate cross section, the method including the steps of:

molding an elastic body having a substantially semi-cylindrical shape;

forming a sheet having a predetermined size;

placing the sheet on a flat surface;

pressing a side surface of the elastic body against the placed sheet; and applying an adhesive to one or both of the side surface of the elastic body and a surface of the sheet against which the elastic body is to be pressed, prior to the pressing step;

wherein the sheet is bonded to the side surface of the elastic body in the pressing step.

(7) With regard to (6) described above, the method further includes the step of applying a mold release agent to any one of the side surface of the elastic body, the surface of the sheet against which the elastic body is to be pressed, and the adhesive.

(8) With regard to (6) or (7) described above, the sheet and the elastic body contain silicone oil, and the sheet is less flexible than the elastic body.

Advantageous Effects of Invention (i) A printing blanket according to the present invention includes a double-layer structure having a flexible elastic body and a lesser-flexible coating layer covering a part of the surface of the elastic body, and therefore excellently fits to a curved to-be-printed surface. Thus, when the printing blanket is deformed, silicone oil contained in the elastic body is substantially blocked by the lesser-flexible coating layer covering the surface of the elastic body, which makes the silicone oil less likely to come out to the surface of the coating layer. Accordingly, it is possible to solve the problems (a) through (d) described above. The number of coating layers is not limited to one. That is, in the case where two, three, or more coating layers are provided, the printing blanket has a three-layer structure, a four-layer structure, or a multi-layer structure having more than four layers.

It should be noted that, in this specification, an elastic body is not limited to those in which the relationship between a load applied thereto and the amount of deformation due to the applied load is liner, but may include those in which that relationship is non-linear and which returns to the original shape immediately after or with a delay of a predetermined time period from when a load having been applied thereto is removed.

Further, "flexible" and "soft" refer to a property of being easily deformed by application of a relatively lower load. For example, in the case of the materials that linearly deform elastically, "flexible" and "soft" are equivalent to having a low elastic modulus. On the other hand, "lesser-flexible" and "hard" refer to a property of requiring a "relatively higher load" to be applied for deformation compared to that required by a substance that is "flexible" or "soft".

(ii) Further, since the thickness of the coating layer is greater at the apex of the elastic body, which is more likely to be worn (degraded or damaged) due to a higher load applied thereto, than in the other area, it is possible to prevent the service life from being reduced due to local wear.

(iii) A printing device according to the present invention has a printing blanket that solves the problems (a) through (e) described above, and therefore can print a clean printing pattern at low cost.

(iv) According to a method of manufacturing a printing blanket of the present invention, the side surface of an elastic body is pressed against a sheet disposed on a flat surface, and thus a printing blanket including an elastic body having a side surface with the sheet bonded thereto is manufactured. That is, the lowermost portion of the side surface of the elastic body comes into contact (line contact) with the sheet. Then, as the elastic body is pressed further, the contact area gradually expands from that position. Therefore, air is prevented from being trapped on the contact surface (i.e., the bonding surface).

Accordingly, it is possible to pick up ink, which has been applied to a printing original plate in accordance with a printing pattern, from the printing original plate accurately (i.e., while preventing a part of the ink from not being picked up (from remaining thereon)), and transfer the ink to a to-be-printed surface accurately. The sheet can be manufactured at low cost, and it is easy to remove a degraded or damaged sheet from the elastic body and bond a new sheet thereto. This allows the elastic body to be used repeatedly and thereby achieves low printing costs.

(v) Further, a mold release agent may be applied to any one of the side surface of the elastic body, the surface of the sheet against which the elastic body is pressed, and the adhesive so as to facilitate replacement of sheets.

It should be noted that the elastic body is made of the same material as related-art printing blankets. Further, although the material of the sheet is not particularly limited, the sheet is capable of picking up ink, which has been applied to a printing original plate (not shown) in accordance with a printing pattern, from the printing original plate when being pressed against the printing original plate, and is capable of delivering the picked-up ink to a to-be-printed surface when being pressed against the to-be-printed surface. Accordingly, the sheet has the substantially same function as the elastic body.

(vi) Moreover, the sheet has elasticity (flexibility) so as to excellently fit to a curved to-be-printed surface. Thus, when the elastic body is deformed, silicone oil contained in the elastic body is substantially blocked by the lesser-flexible sheet covering the surface of the elastic body, which makes the silicone oil less likely to come out to the surface of the coating layer. Accordingly, it is possible to solve the problems (a) through (e) described above.

(vii) The sheet may be less flexible than the sheet in order to make the substantial blocking effect by the sheet more pronounced. The present invention, however, is not limited thereto.

DESCRIPTION OF EMBODIMENTS

Embodiment 1: Printing Blanket

Figure 1:
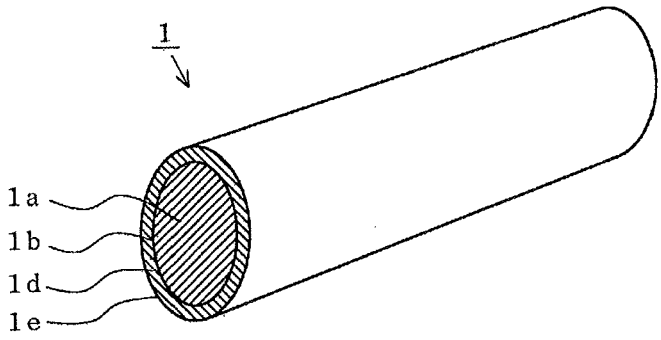
FIG. 1 is a perspective view illustrating a printing blanket according to Example 1 in Embodiment 1 of the present invention.
Figure 2:
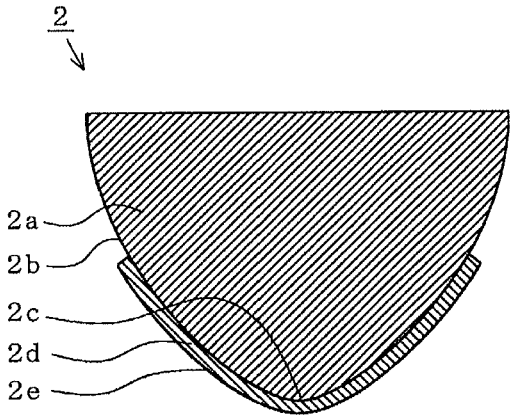
FIG. 2 is a cross-sectional view illustrating a printing blanket according to Example 2 in Embodiment 1 of the present invention.
Figure 3:
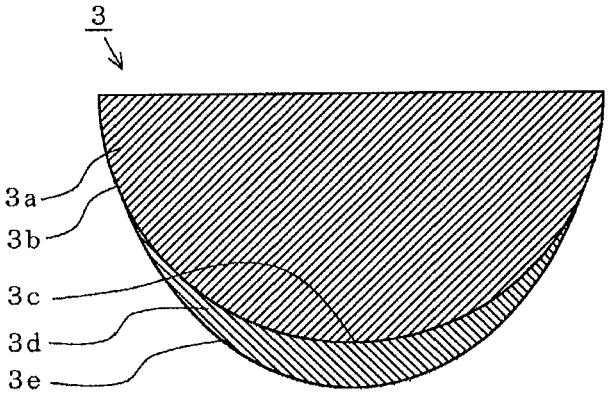
FIG. 3 is a cross-sectional view illustrating a printing blanket according to Example 3 in Embodiment 1 of the present invention.

FIGS. 1 through 3 illustrate a printing blanket according to Embodiment 1 of the present invention. More specifically, FIG. 1 is a schematic perspective view of Example 1; FIG. 2 is a schematic cross-sectional view of Example 2; and FIG. 3 is a schematic cross-sectional view of Example 3.

EXAMPLE 1

Referring to FIG. 1, a printing blanket 1 according to Example 1 has a double-layer structure formed of an elastic body la having a cylindrical shape, and a coating layer 1*d* covering an outer circumferential surface 1*b* of the elastic body 1*a*.

The elastic body 1*a* and the coating layer 1*d* contain silicone oil in order to ensure transfer (pick-up and deliver) of ink and to impart elasticity (flexibility) thereto. The coating layer 1*d* is harder (contains a smaller amount of silicone oil) than the elastic body 1*a*.

Accordingly, the elastic body 1*a* is easily deformed, and the coating layer 1*d* is deformed in accordance with deformation of the elastic body 1*a*. Therefore, the printing blanket 1 excellently fits to the curved to-be-printed surface. Further, when the printing blanket 1 is deformed, the silicone oil contained in the elastic body 1*a* is substantially blocked by the coating layer 1*d* surrounding the elastic body 1*a*. Also, the content of the silicone oil in the coating layer 1*d* is small. Therefore, the silicone oil is less likely to come out to a surface 1*e* of the coating layer 1*d*.

It should be noted that, in the present invention, the number of coating layers 1*d* is not limited to one, and additional one, two, or more coating layers may be provided on top of the coating layer 1*d*. In this case, the printing blanket 1 has a three-layer structure, a four-layer structure, or a multi-layer structure having more than four layers.

The coating layer 1*d* is bonded to the elastic body 1*a*. Therefore, in the case where the coating layer 1*d* is worn (degraded or damaged), the entire or a part of the worn coating layer 1*d* may be removed such that a new coating layer may be formed thereon by using a coating process or the like. In this case, the printing blanket 1 has a double-layer structure formed of the original elastic body 1*a* and a new coating layer, or has a three-layer structure formed of the original elastic body 1*a*, a part of the worn original coating layer 1*d*, and a new coating layer.

It should be noted that, although the entire (360 degrees) outer circumferential surface of the elastic body 1*a* is covered by the coating layer 1*d* in the above description, the present invention is not limited thereto. For example, half the outer circumferential surface (180 degrees) or a third of the outer circumferential surface (120 degrees) of the elastic body 1*a* may be covered by the coating layer 1*d*. Further, in place of a cylindrical shape, the elastic body 1*a* may have a semi-cylindrical shape such that a part or a front portion of the arcuate surface thereof may be covered by a coating layer.

Since the printing blanket 1 is formed such that the silicone oil is less likely to come out to the surface 1*e*, the following advantageous effects are obtained.

(A) Ink applied to a printing original plate (not shown) is reliably transferred to the printing blanket 1. This allows a printing pattern (not shown) to be clearly printed on a to-be-printed surface.

(B) Ink is prevented from accumulating on the printing original plate (not shown), whereby the printing original plate is prevented from being contaminated. This allows a printing pattern to be printed clean without any smear (not shown).

(C) Further, there is no need to frequently clean the printing original plate (not shown), which prevents the surface thereof being roughened and thus extends the service life thereof. This reduces the frequency of replacing with a new printing original plate, resulting in reduced printing costs (equipment costs).

(D) In the case where the coating layer is worn (degraded or damaged), the printing blanket can be used continuously only by replacing the entire or a part of the coating layer 1*d* without replacing elastic bodies, which results in low material costs.

(E) Further, it is possible to print a printing pattern across a wide area on a curved surface using a single printing blanket 1. This simplifies the printing process and thereby reduces the printing costs. This also makes it possible to impart design properties to the printing pattern and thereby enhances the commercial value of the print object.

(F) Furthermore, even in the case of applying a surface treatment such as coating onto the to-be-printed surface, since there is little silicone oil adhering the to-be-printed surface, the coating is prevented from being repelled by the silicone oil, which allows a high-quality to-be-printed surface (coating surface) to be obtained.

EXAMPLE 2

Referring to FIG. 2, a printing blanket 2 according to Example 2 has a double-layer structure formed of an elastic body 2*a* having a substantially quadrangular pyramidal shape, and a coating layer 2*d* covering a predetermined area of side faces 2*b* of the elastic body 2*a*, which predetermined area contains an apex 2*c* of the elastic body 2*a*.

The elastic body 2*a* has a substantially arcuate triangular cross section with the side faces 2*b* projecting outward. The adjacent side faces 2*b* are smoothly connected to each other, and the apex 2*c* where the four side faces 2*b* meet has a substantially partial spherical shape.

The elastic body 2*a* and the coating layer 2*d* contain silicone oil in order to ensure transfer (pick-up and deliver) of ink. The coating layer 2*d* is harder than the elastic body 2*a*.

Accordingly, the elastic body 2*a* is easily deformed, and the coating layer 2*d* is deformed in accordance with deformation of the elastic body 2*a*. Therefore, as in the case of the printing blanket 1 of Example 1, the printing blanket 2 excellently fits to the curved to-be-printed surface, and the silicone oil is less likely to come out to a surface 2*e* of the coating layer 2*d*.

It should be noted that, although a part of the side faces 2*b* containing the apex 2*c* of the elastic body 2*a* is covered by the coating layer 2*d* in the above description, the present invention is not limited thereto. The entire side faces 2*b* may be covered by the coating layer 2*d*. Further, in place of a substantially quadrangular pyramidal shape, the elastic body 2*a* may have a shape similar to a three-sided pyramid, or a five or more-sided pyramid. The elastic body 2*a* may have a conical shape with a rounded apex.

EXAMPLE 3

Referring to FIG. 3, a printing blanket 3 according to Example 3 has a double-layer structure formed of an elastic body 3*a* having a hemispherical shape, and a coating layer 3*d* covering a predetermined area of an outer surface 3*b* of the elastic body 3*a*, which predetermined area contains an apex (i.e., a south pole in FIG. 3) 3*c* of the elastic body 3*a*.

The elastic body 3*a* and the coating layer 3*d* contain silicone oil in order to ensure transfer (pick-up and deliver) of ink. The coating layer 3*d* is harder than the elastic body 3*a*. Further, since the apex 3*c* and a portion in the vicinity of the apex 3*c* are more likely to be worn (degraded or damaged) due to high pressure applied thereto, the thickness of the coating layer 3*d* is greater in this area than in the area away from the apex 3*c*.

Therefore, as in the case of the printing blanket 1 of Example 1, the printing blanket 3 excellently fits to the curved to-be-printed surface, and the silicone oil is less likely to come out to a surface 3*e* of the coating layer 3*d*. Further, although the apex 3*c* and a portion in the vicinity of the apex 3*c* are more likely to be worn due to high pressure that is applied thereto due to a pressing motion upon picking up the ink and upon delivering the ink to the to-be-printed surface, since the thickness of the coating layer 3*d* is greater in the vicinity of the apex 3*c*, the service life of the printing blanket 3 is extended.

Further, only by forming a new coating layer for only a worn portion or only a predetermined area containing the worn portion, the original printing blanket 3 and the remaining portion of the original coating layer 3*d* can be used continuously. Therefore, with inexpensive repairs, the printing blanket 3 can be used for a long period of time. Furthermore, as in the case of the printing blanket 1, a wide area of the coating layer 3*d* may be replaced. This results in low component costs.

It should be noted that the shape of the elastic body 3*a* is not limited and may have a shape similar to a cone or pyramid, or a semi-cylindrical shape. Further, the size of the area covered with the coating layer 3*d* is not limited as long as the area contains the apex 3*c*.

Embodiment 2: Printing Device

Figure 4:
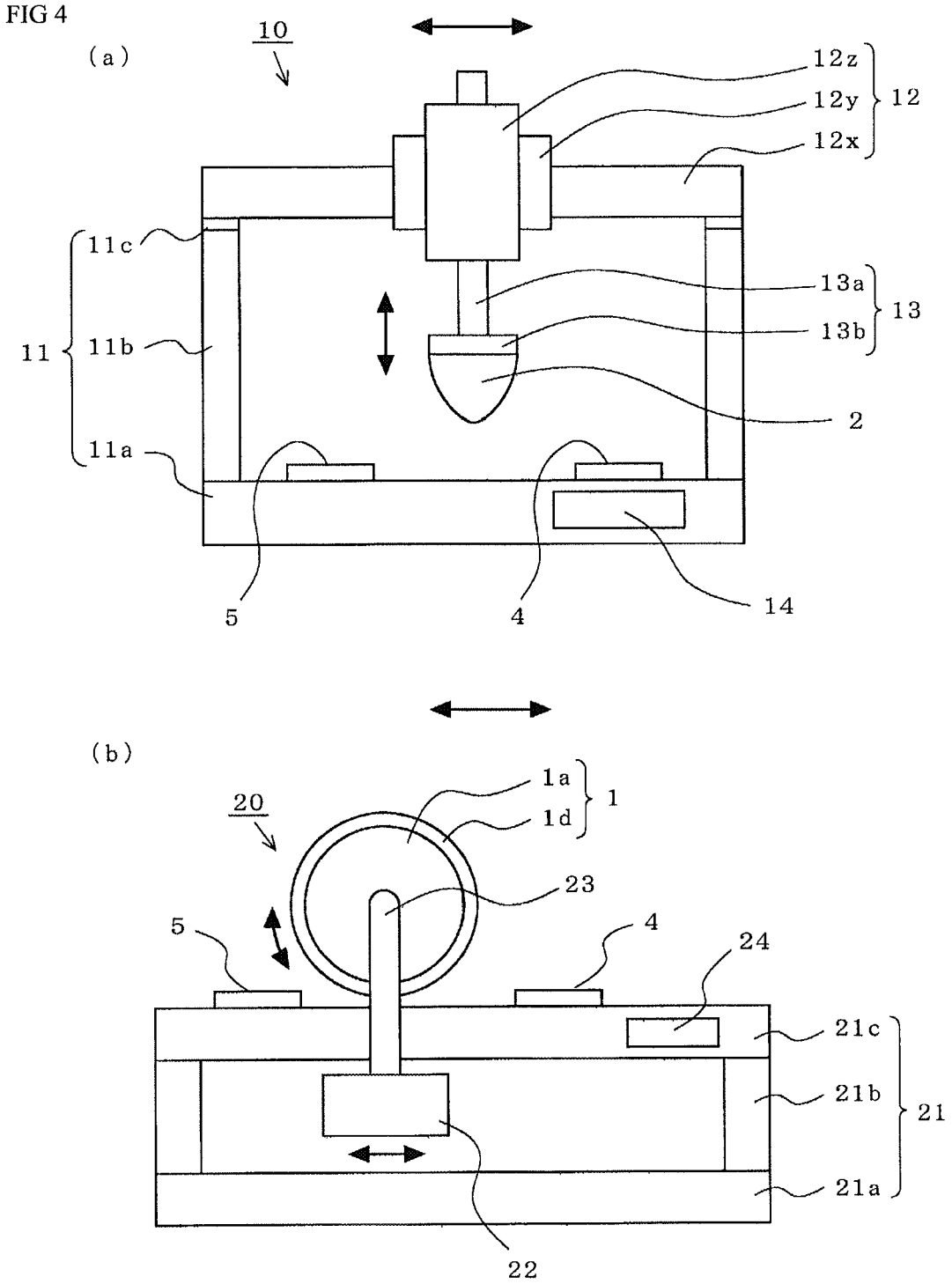
FIG. 4 is a schematic front view illustrating a printing device according to Embodiment 2 of the present invention.

FIG. 4 is a schematic front view illustrating a printing device according to Embodiment 2 of the present invention.

Referring to (a) of FIG. 4, a printing device 10 includes a main body 11, a moving unit 12, a pad mounting unit 13, a controller 14, and the printing blanket 2 (see Example 2).

The main body 11 includes a main body base 11*a*, a main body stand 11*b* fixed to the main body base 11*a*, and a main body rail 11*c* fixed to the upper end of the main body stand 11*b*.

The moving unit 12 includes an X-direction moving beam 12*x* movably supported by (disposed on or suspended on) the main body rail 11*c*, a Y-direction moving beam 12*y* movably supported by (disposed on or suspended on) the X-direction moving beam 12*y*, and a lifting unit 12*z* that is disposed on the Y-direction moving beam 12*y* and is configured to lift and lower the pad mounting unit 13.

The pad mounting unit 13 includes a mounting bar 13*a* configured to be lifted or lowered by the lifting unit 12*z*, and a mounting plate 13*b* fixed to the lower end of the mounting bar 13*a*. The printing blanket 2 is mounted on the lower surface of the mounting plate 13*b*.

The controller 14 moves the moving unit 12 so as to perform printing in accordance with an entered predetermined printing procedure. That is, the printing blanket 2 is moved to a position facing a printing original plate (i.e., an image plate) 4 on which ink is disposed in accordance with a printing pattern, and is lowered to be pressed against the printing original plate 4, so that the ink is transferred to (picked up by) the printing blanket 2. Then, the printing blanket 2 is lifted, is moved to a position facing a print object 5, and is lowered so as to transfer (deliver) the ink to a to-be-printed surface. Thus, a printing pattern is printed on the surface of the print object 5.

Thus, since the printing device 10 includes the printing blanket 2 (Example 2), it is possible to print a clear and clean printing pattern on the to-be-printed surface at low costs. It is also possible to enhance the commercial value of the print object by printing a printing pattern with design properties imparted thereto.

It should be noted that the printing blanket 1 or the printing blanket 3 may be used in place of the printing blanket 2.

Further, the moving unit 12 illustrated in the above description is formed of members that move in three directions, respectively. However, the present invention is not limited there to, and the moving unit 12 may include a robot whose distal end is movable in three directions.

Referring to (b) of FIG. 4, a printing device 20 includes a main body 21, a moving unit 22, a pad supporting unit 23, a controller 24, and the printing blanket 1 (see Example 1).

The main body 21 includes a main body base 21*a*, a main body stand 21*b* fixed to the main body base 21*a*, and a main body rail 21*c* fixed to the upper end of the main body stand 21*b*.

The moving unit 22 is movably supported by (suspended on) the main body rail 11*c*, and is configured to move itself in accordance with a control signal from the controller 24.

The pad supporting unit 23 has an end mounted on the moving unit 22 and the other end rotatably supporting the center of the printing blanket 1.

The controller 24 moves the moving portion 22 so as to perform printing in accordance with an entered predetermined printing procedure. That is, when the moving unit 22 moves rightward, the printing blanket 1 rotates while being pressed against a printing original plate (i.e., an image plate) 4 on which ink is disposed in accordance with a printing pattern, so that the ink is transferred to (picked up by) the printing blanket 1. Then, when the moving unit 22 moves leftward, the printing blanket 1 rotates while being pressed against a print object 5 so as to transfer (deliver) the ink to a to-be-printed surface. Thus, a printing pattern is printed on the surface of the print object 5.

In order to prevent the surface le of the printing blanket 1 from sliding with respect to the surface of the printing original plate 4 and to prevent the surface le of the printing blanket 1 from sliding with respect to the surface of the print object 5, the moving speed of the moving unit 22 is equal to the peripheral speed of the surface 1*e*.

Thus, since the printing device 20 includes the printing blanket 1 (Example 1), it is possible to print a clear and clean printing pattern on the to-be-printed surface at low costs. It is also possible to enhance the commercial value of the print object by printing a printing pattern with design properties imparted thereto.

Embodiment 3: Method of Manufacturing Printing Blanket

Figure 5:
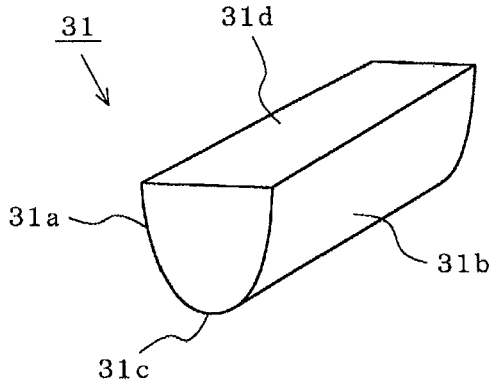
FIG. 5 illustrates a method of manufacturing a printing blanket according to Embodiment 3 of the present invention, wherein (a) of FIG. 1 is a perspective view of an elastic body, and (b) is a perspective of a sheet.
Figure 5:
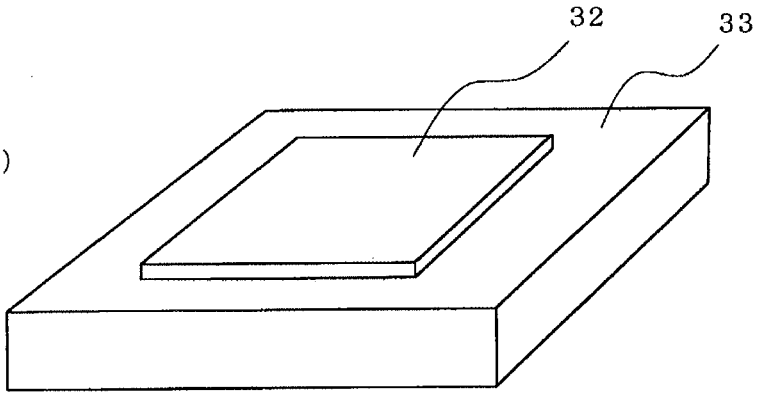
Figure 6:
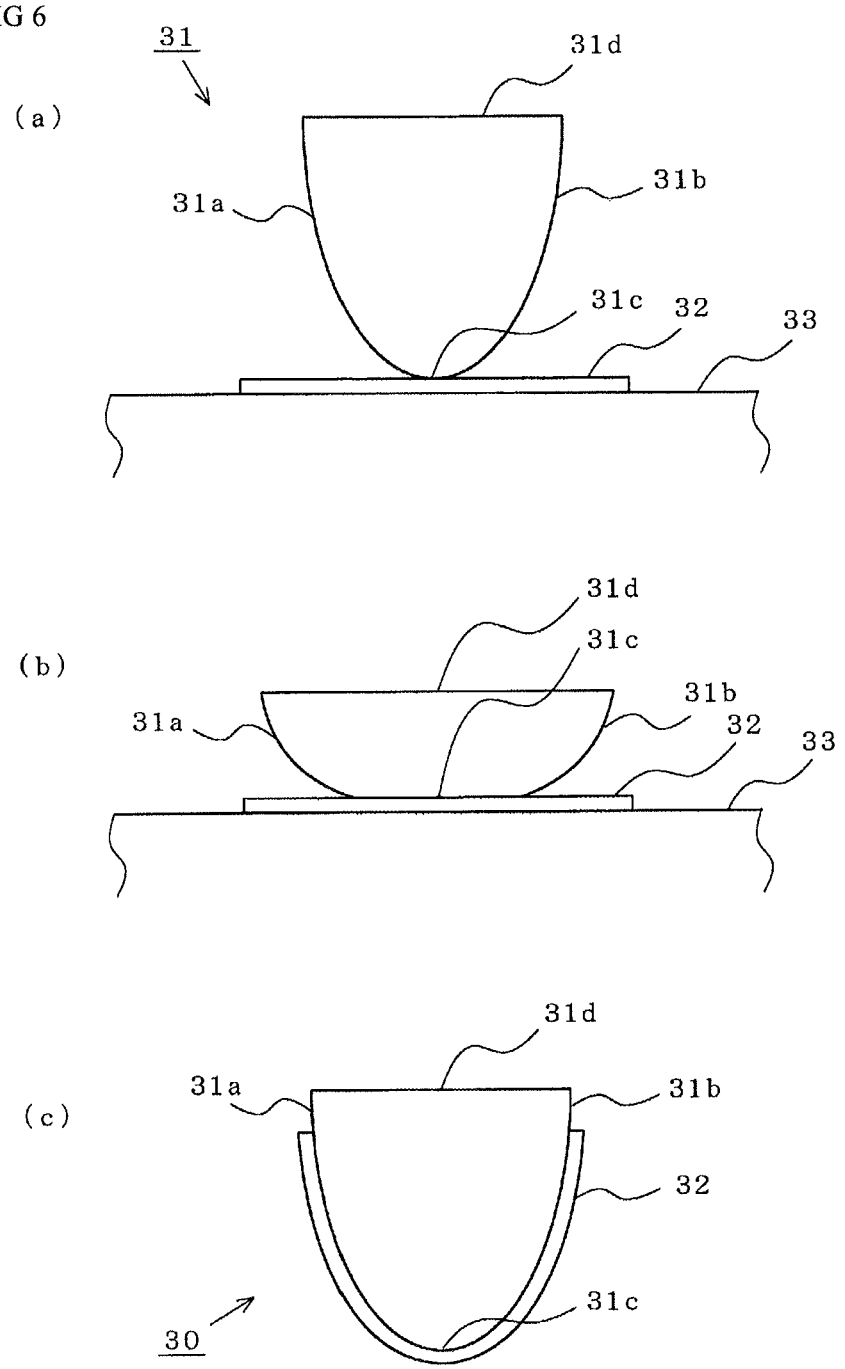
FIG. 6 shows front views for illustrating respective steps of the method of manufacturing a printing blanket according to Embodiment 3 of the present invention.
Figure 7:
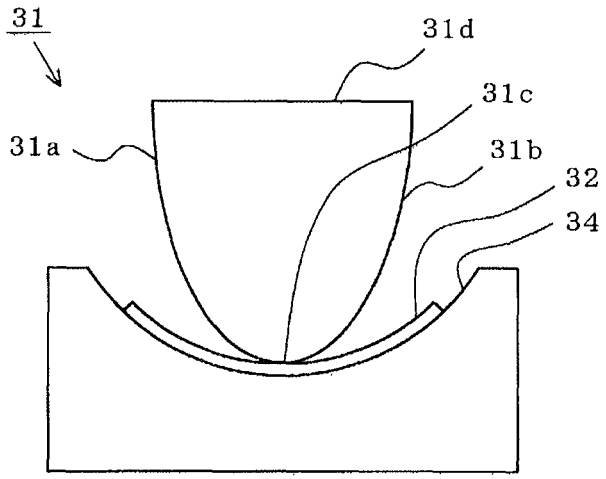
FIG. 7 is a front view for illustrating another example of the method of manufacturing a printing blanket according to Embodiment 3 of the present invention.

FIGS. 5 through 7 illustrate a method of manufacturing a printing blanket according to Embodiment 3 of the present invention. More specifically, (a) of FIG. 5 is a schematic perspective view of a part (an elastic body); (b) of FIG. 5 is a schematic perspective view of a part (a sheet); FIG. 6 shows front views for illustrating respective steps; and FIG. 7 is a schematic front view of another example. It should be noted that the same components are denoted by the same reference signs throughout the drawings, and a description thereof will be partially omitted. Further, the drawings are schematically illustrated, and the present invention is not limited to the shapes shown in the drawings (in particular, the thickness of the sheet is illustrated with exaggeration).

Referring to FIGS. 5 through 7, a printing blanket 30 has a substantially semi-cylindrical shape, and has a double-layer structure formed of an elastic body 31 and a sheet 32 bonded to the side surface of the elastic body 31.

The elastic body 31 includes a side face 31*a* defining a convex surface, another side face 31*b* that is plane-symmetric to the side face 31*a*, a ridge line 31*c* (technically, this portion has a certain width, but is referred to as a "line" for explanation purposes) smoothly connecting between the side surface 31*a* and the side surface 31*b*, and a mounting surface 1*d* serving as a mounting surface to be attached to a printing apparatus (not shown).

It should be noted that the ridge line 31*c* defines the lowermost end of the elastic body 31. Further, the cross sections of the side faces 31*a* and 31*b* do not have a perfect semicircular shape, but have a bullet shape (see (a) of FIG. 5 and (c) of FIG. 6).

The sheet 32 has a rectangular shape with a predetermined thickness (e.g., 1 mm), and is capable of picking up ink, which has been applied to a printing original plate (not shown) in accordance with a printing pattern, from the printing original plate when being pressed against the printing original plate, and is capable of delivering the picked-up ink to a to-be-printed surface (not shown) when being pressed against the to-be-printed surface. The material (substance) thereof is not particularly limited.

The elastic body 31 is also capable of picking up ink, which has been applied to a printing original plate (not shown) in accordance with a printing pattern, from the printing original plate through the sheet 32 when being pressed against the printing original plate, and is capable of delivering the picked-up ink to a to-be-printed surface (not shown) through the sheet 32 when being pressed against the to-be-printed surface. The material (substance) thereof is not particularly limited.

Next, a description will be given of a manufacturing method with reference to FIG. 6.

An elastic body 31 having a substantially semi-cylindrical shape (a bullet-shaped cross section) is molded.

Also, a sheet having a predetermined size (thickness, vertical length, and horizontal length) is formed. The sheet may be obtained by molding a sheet into a predetermined size, or by cutting a large sheet into a rectangle of a predetermined size.

Subsequently, the sheet 32 is placed on a flat surface 33 (see (b) of FIG. 5).

Then, an adhesive (not shown) is applied to the side faces 31*a* and 1*b* and the ridge line 31*c*, and the elastic body 31 is lowered in the normal direction of the flat surface 33 so as to be pressed against the sheet 32 (see (a) and (b) of FIG. 6). Thus, the ridge line 31*c* of the elastic body 31 first comes into contact (line contact) with the sheet 32. Then, as the elastic body 31 is pressed further, the elastic body 31 (and the sheet 32 which deforms in accordance with deformation of the elastic body 31) is deformed. Thus the contact location gradually moves in the direction away from the ridge line 31*c* such that the contact area expands (the contact surface expands so as to cover a greater area of the side faces 31*a* and 1*b*). This prevents air from being trapped on the contact surface (i.e., the bonding surface).

Then, when the entire surface of the sheet 32 comes into contact with (is bonded to) the elastic body 31, lowering of the elastic body 31 is stopped.

Then, immediately after stopping lowering of the elastic body 31, or after maintaining the elastic body 31 in a pressed state for a predetermined time period after stopping lowering of the elastic body 31, the elastic body 31 is lifted. Thus, the elastic body 31 returns to the original shape. In this way, a printing blanket 30 formed of the elastic body 31 with the sheet 32 bonded thereto (see (c) of FIG. 6) is obtained.

Since the printing blanket 30 does not have any bubble (that is small enough to be invisible to the naked eye) trapped on the bonding surface of the sheet 32, it is possible to prevent a part of the to-be-printed surface from not being printed (prevent blank portions from remaining on the to-be-printed surface) and therefore to perform high-quality printing.

Moreover, the sheet 32 can be manufactured at low cost, and it is easy to bond the sheet 32 to the elastic body 31. Therefore, even if the surface of the sheet 32 is locally degraded or damaged due to use, the degraded sheet 32 can be removed and replaced with a new sheet 32 at low cost. This allows high-quality printing to be performed continuously at low cost.

On the other hand, in the case of forming, in place of the sheet 32, a coating body having an inner surface that has a shape matching the shapes of the side faces 31*a* and 1*b* of the elastic body 31 and having a predetermined thickness by molding using a die, it is necessary to form a die for each shape of the elastic body 31, resulting in an increase in the manufacturing cost of the printing blanket. Further, when bonding the coating body to the elastic body 31, air is trapped between the inner surface of the coating body and the side faces 31*a* and 1*b* of the elastic body 31, and therefore high-quality printing cannot be performed.

It should be noted that, although an adhesive is applied to the elastic body 31 before the pressing step, the present invention is not limited thereto. An adhesive may be applied to the sheet 32 in place of the elastic body 31, or to both the sheet 32 and the elastic body 31. Further, the method of applying an adhesive is not particularly limited. An adhesive may be applied using a brush, or may be applied by spraying using a spray.

Further, the sheet 32 may be placed on a concave surface 34 having an arcuate cross section (see FIG. 7) in place of the flat surface 33. In this case, as in the case where the elastic body 31 is pressed against the flat surface 33, since the contact area gradually expands in a predetermined direction, air is prevented from being trapped on the contact surface (i.e., the bonding surface), which allows high-quality printing to be performed.

Embodiment 4: Method of Manufacturing Printing Blanket

Figure 8:
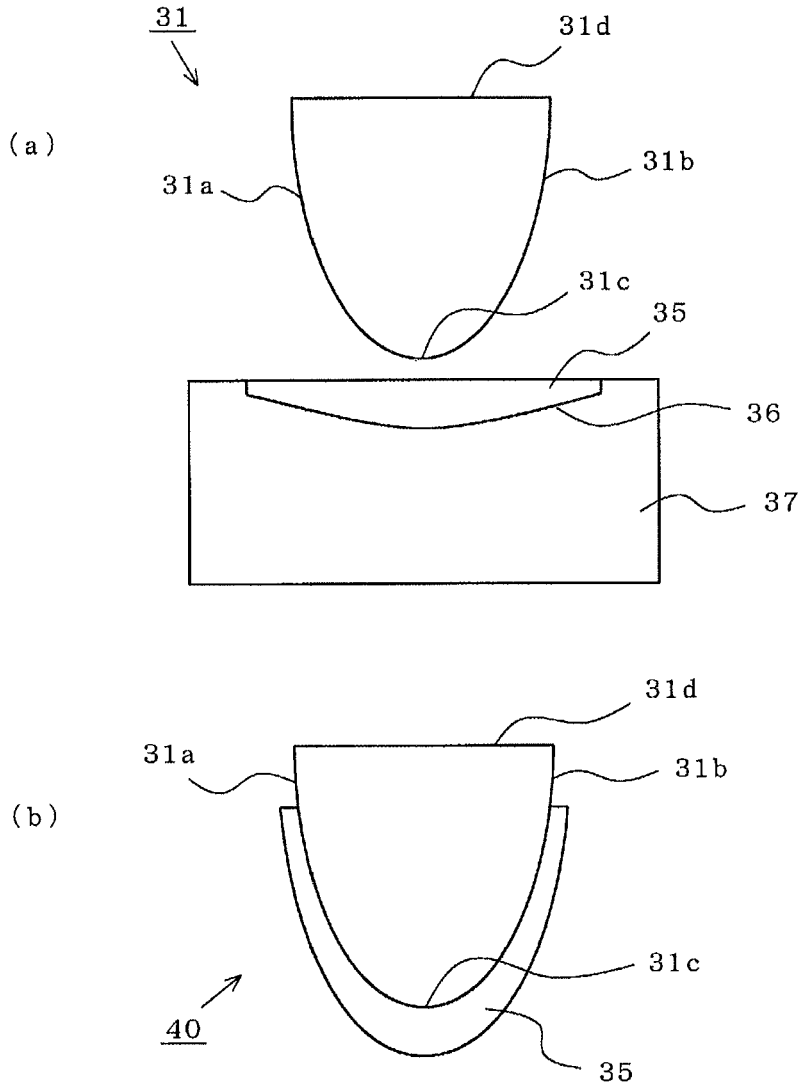
FIG. 8 shows front views for illustrating respective steps of the method of manufacturing a printing blanket according to Embodiment 4 of the present invention.

FIG. 8 shows front views for illustrating respective steps of the method of manufacturing a printing blanket according to Embodiment 4 of the present invention. It should be noted that the same components as those in Embodiment 3 are denoted by the same reference signs, and a description thereof will be partially omitted.

Referring (a) of FIG. 8, a sheet 35 has a thickness that gradually increases toward the center thereof in a width direction thereof. Further, the sheet 35 is disposed on a recessed surface 36 of a work table 37. The recessed surface 36 is smoothly recessed toward the center thereof in a width direction thereof. In this case, since the depth of the recess of the recessed surface 36 varies in accordance with the varying thickness of the sheet 35 in the width direction, the upper surface of the sheet 35 placed on the recessed surface 36 is flat. Accordingly, when the elastic body 31 is pressed against the sheet 35 having a flat upper surface, air is prevented from being trapped on the contact surface (i.e., the bonding surface), which allows high-quality printing to be performed.

Referring to (b) of FIG. 8, as in the case of Embodiment 3, a printing blanket 40 is formed by pressing the elastic body 31 against the sheet 35. Since the sheet 35 bonded to the printing blanket 40 has a thickness that gradually increases toward the ridge line 31*c* gradually, that is, since the sheet 35 has a greater thickness in an area that is more likely to be severely worn, the printing blanket 40 can be used for a longer period of time.

INDUSTRIAL APPLICABILITY

According to the present invention, a printing blanket excellently fits to a curved to-be-printed surface while preventing silicone oil contained in the printing blanket from coming out to the surface of the printing blanket when the printing blanket is deformed. Accordingly, the present invention is widely used as printing blankets of various shapes and sizes, and printing devices having the printing blankets. Further, a sheet is bonded to an elastic body while preventing air from being trapped therebetween, which allows high-quality printing to be performed. Therefore, it is possible to manufacture a printing blanket at low cost. Accordingly, the present invention can be widely used a printing blanket manufacturing method for manufacturing printing blankets of various shapes and sizes.

REFERENCE SIGNS LIST

1 printing blanket (Example 1)
1*a* elastic body
1*b* outer circumferential surface
1*d* coating layer
1*e* surface
2 printing blanket (Example 2)
2*a* elastic body
2*b* side face
2*c* apex
2*d* coating layer
2*e* surface
3 printing blanket (Example 3)
3*a* elastic body
3*b* outer surface
3*c* apex
3*d* coating layer
3*e* surface
4 printing original plate
5 print object
10 printing device (Embodiment 2)
11 main body
11*a* main body base
11*b* main body stand
11*c* main body rail
12 moving unit
12*x* X-direction moving beam
12*y* Y-direction moving beam
12*z* lifting unit
13 pad mounting unit
13*a* mounting bar
13*b* mounting plate
14 controller
20 printing device (Embodiment 2)
21 main body
21*a* main body base
21*b* main body stand
21*c* main body rail
22 moving unit
23 pad supporting unit
24 controller
31 elastic body
31*a* side face
31*b* side face
31*c* ridge line
31*d* mounting surface
32 sheet
33 flat surface
34 concave surface
35 sheet
36 recessed surface
37 work table
30 printing blanket (Embodiment 3)
40 printing blanket (Embodiment 4)

The invention claimed is:

1. A method of manufacturing a printing blanket including an elastic body having a substantially semi-cylindrical shape and a sheet bonded to a side surface of the elastic body, the sheet having a substantially arcuate cross section at a location from an apex of the arcuate cross section to a position away from the apex, the method comprising the steps of:

molding the elastic body having a substantially semi-cylindrical shape;

forming the sheet having a predetermined size whose thickness gradually decreases from the center towards the sides;

placing the sheet on a flat surface or a concave surface;

pressing a side surface of the elastic body against the placed sheet; and applying an adhesive to one or both of the side surface of the elastic body at a location between the apex and a position away from the apex and a surface of the sheet against which the elastic body is to be pressed, prior to the pressing step;

wherein the thickness of the sheet bonded to the side surface of the elastic body by the pressing step at the apex and the vicinity thereof is greater than the thickness at the position away from the apex.

2. The method of manufacturing a printing blanket of claim 1, further comprising the step of:

applying a mold release agent to any one of the area from the apex to the position away from the apex of the side surface of the elastic body, the surface of the sheet against which the elastic body is to be pressed, and the adhesive.

3. The method of manufacturing a printing blanket of claim 1, wherein the sheet and the elastic body contain silicone oil, and the sheet is less flexible than the elastic body.

* * * * *